US009167928B2

(12) United States Patent
Hanners

(10) Patent No.: US 9,167,928 B2
(45) Date of Patent: Oct. 27, 2015

(54) FLOW LIMITING DRINKING STRAW

(71) Applicant: Jennifer Hanners, Lubbock, TX (US)

(72) Inventor: Jennifer Hanners, Lubbock, TX (US)

( * ) Notice: Subject to any disclaimer, the term of this patent is extended or adjusted under 35 U.S.C. 154(b) by 0 days.

(21) Appl. No.: 14/149,783

(22) Filed: Jan. 7, 2014

(65) Prior Publication Data

US 2014/0191060 A1 Jul. 10, 2014

Related U.S. Application Data

(60) Provisional application No. 61/749,793, filed on Jan. 7, 2013.

(51) Int. Cl.
*A47G 21/18* (2006.01)
*A61J 7/00* (2006.01)

(52) U.S. Cl.
CPC ..... *A47G 21/185* (2013.01); *A47G 21/18* (2013.01); *A61J 7/0038* (2013.01)

(58) Field of Classification Search
CPC ..... A61J 7/0038; A47G 21/18–21/189; A47G 2400/027; F16K 5/02–5/0292; Y10T 137/7913
USPC ..... 239/29, 32
See application file for complete search history.

(56) References Cited

U.S. PATENT DOCUMENTS

| | | | | |
|---|---|---|---|---|
| 1,813,285 | A * | 7/1931 | Galetschky | 239/33 |
| 3,438,527 | A * | 4/1969 | Gamblin, Jr. | 215/388 |
| 6,273,128 | B1 * | 8/2001 | Paczonay | 137/512.3 |
| 7,354,007 | B2 * | 4/2008 | Pearson | 239/33 |
| 2005/0092373 | A1 * | 5/2005 | Schafer et al. | 137/533.11 |
| 2007/0262164 | A1 * | 11/2007 | Gelfand | 239/33 |

* cited by examiner

*Primary Examiner* — Arthur O Hall
*Assistant Examiner* — Juan C Barrera
(74) *Attorney, Agent, or Firm* — Sarah Hegi Simpson; McWhorter, Cobb and Johnson, LLP

(57) ABSTRACT

A fluid flow regulating component adapted for sealed engagement to a drinking straw is provided to prevent excess fluid flow to users drinking with a straw. The device has a body adapted to engage the straw at one end to direct fluid flow through an axial cavity to an exit aperture. A translating valve body within the axial cavity ceases fluid flow during periods of excess acceleration or volume. A secondary valve may be engaged to prevent backflow of the fluid.

7 Claims, 1 Drawing Sheet

FLOW LIMITING DRINKING STRAW

This application claims priority to U.S. Provisional Patent Application Ser. No. 61/749793, filed on Jan. 7, 2013, and incorporated herein in its entirety by this reference thereto.

BACKGROUND OF THE INVENTION

1. Field of the Invention

The present invention relates generally to drinking straws. More particularly, the invention relates to a straw device for consumption of liquids from a reservoir in a vessel, which provides a means for regulating fluid flow of fluid volume, velocity, and acceleration, on exit from the proximal end of the straw during which suction is imparted by a user. The device is removably engageable to conventional straws without the need to modify the existing straw or can be formed as a unitary structure.

2. Prior Art

Drinking straws are a convenient way to drink fluids from containers and in some instances may be a necessity for certain individuals such as hospital patients, children, the elderly, disabled persons, and others. While some such individuals are able to employ a cup or limited pouring glass device, for many patients, a straw is the only means for ingesting liquid from a container holding it. Such patients may have suffered from a stroke causing facial paralysis or other motor function problems inhibiting muscular control of the mouth and/or throat. For patients suffering from facial paralysis affecting one side of their mouths, or causing lack of muscle control, or lack of experience using a straw, there is an inherent risk if they are allowed to ingest the total volume of liquid reaching the distal end of the straw on which they are sucking. Further, for patients recovering from head trauma or brain trauma, there can be a lack of reflexes as well as lost knowledge on how to swallow and how hard to suck on a straw. Such patients can suffer severe health problems should fluid from a straw be communicated to the lungs from misuse or lack of ability to use the straw properly.

As such, within the medical realm there exists a population of patients who, because of inexperience with straws or various congenital or acquired physical disorders, have deficient oropharyngeal or oral motor function which impairs their ability to manipulate and transport food and fluids placed in their mouths. Due to such poor control of the oropharyngeal muscles, such patients may tend to draw too much fluid through a straw, or such patients may have reflexes which are slow to swallow the volume of fluid drawn through the proximal end of the straw which can lead to the fluid being accelerated into the mouth and throat which can cause choking and communication of the fluid to the lungs.

As a result of such inherent or acquired disabilities, many patients are in constant danger of ingesting too much fluid when sucking on a straw to drink or sucking too hard and causing excess acceleration of the discharge of the fluid to their mouths. Whether there is an excess of fluid or fluid discharging to the mouth at high acceleration, many patients are just unable to effectively swallow the volume of fluid naturally drawn into their mouths.

Excess fluid volume or over accelerated fluid can result in the patient losing the drawn fluid out of their mouth or nose through choking or coughing, thereby yielding an embarrassing occurrence. Worse yet, patients who ingest too much in a suck of the straw or fail to dispose of the fluid from the nose or mouth during choking may suffer from passage of the fluid into their lungs. Communication of such fluid to the lungs can result in respiratory arrest, or more often, a lung infection from fluid being deposited in their lungs.

To limit or eliminate the danger and embarrassment to patients from such occurrences, a drinking straw is needed that limits both the acceleration and the volume of fluid a patient can suck from the distal end and bring into their mouth during each instance.

As a result, prior art has shown many attempts to provide straw devices which solve these problems. U.S. Pat. No. 7,354,007 to Pearson teaches a therapeutic training straw for controlling the intake of beverages. The device to Pearson generally comprises an elongated straw body having a flow limiting compartment axially aligned with the straw body. The compartment houses an insoluble object which can be positioned to stop the flow of fluid through the compartment by imparting a suction force on the straw to draw the object to a fluidly sealed position within the compartment.

The device to Pearson is intended to regulate the amount of liquid a user may drink in one sip, and in the event of excessive suction and acceleration of fluid through the straw, it provides a seal to stop fluid flow to prevent inadvertent aspiration by the user.

However, the device to Pearson relies solely on an insoluble object to properly seal the conduit from further fluid flow in the event of excessive volume suction or acceleration of fluid through the straw. Pearson does not teach any means for regulating fluid volumetric flow rate into the compartment as may be needed to further regulate and control fluid flow through the straw.

As such, there exists a need for a flow regulating apparatus that will limit both the volumetric flow rate and acceleration of fluid exiting the distal end of the straw to the user's mouth. Further, such a device, depending on the fluid flow rate, should provide a means to limit the maximum volume of fluid allowed to exit the distal end of the straw into a user's mouth during each suck upon the straw. Such a device should be easily engageable with conventional straws without the need to permanently modify the existing straw. Such a device should provide a means for varying the flow rates and the maximum fluid volume in relation to flow rate during each impartation of suction by the user to allow for different flow rates and maximum potential volume dispensed to a user depending on their ability to swallow.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device and method herein disclosed and described provides a solution to the shortcomings in prior art and achieves the above noted goals through the provision of a straw engageable device configured to yield a fluid flow regulator employing one or a combination of a means for volumetric flow rate restriction, a means for fluid acceleration restriction, and a means for dispensed fluid volume restriction.

In accordance with a first preferred mode, the device configured with an elongated body having apertures disposed at proximal and distal ends of the body. An axial passage communicates within the body between the proximal and distal ends. The body can be formed form conventional materials such as plastic or metal, however can be formed from any material suitable for the intended purposes set forth in this disclosure and as would occur to those skilled in the art upon reading this disclosure.

Means for volumetric flow rate limitation or restriction is preferably provided by a removably engageable valve component which is configured for an insertion into operational engagement into the distal end of the straw body to an engaged position. So engaged, the valve component is also aligned with the axial passage of the body. The valve component is preferably formed of flexible material such as rubber, or flexible plastic or polymeric material, however it can be formed from any material suitable for the intended purpose of flow cessation or restriction. The valve component configured to provide a means for limiting volumetric flow rate or a restriction thereof, may be in the form of a duckbill or reed type valve. However, other preferred configurations are provided in more detail below.

In all modes, the valve operationally engaged at the distal end of the straw body, is closed when the user is not sucking on the distal end of the straw. However, at least one aperture allowing fluid to pass through the valve will open gradually as fluid is accelerated through the device by the user sucking from the proximal end. This gradual opening provides a gradually enlarging fluid passage to communicate fluid to the mouth of a user. The gradual opening from closed to larger open positions also provides a means for gradually increasing flow rate of fluid through the valve and means to prevent excess acceleration upon suction by the user on the distal end.

As such, the axial passage communicating liquid through the body of the straw is provided a fluid flow which is regulated by operation of the valve. The regulation prevents over acceleration of fluid from the straw and caps the fluid flow by volume to a maximum flow rate which is determined by a maximum opening of the valve for communication of fluid therethrough.

Thus, the valve component operatively engaged with the body of the straw, provides a means for limiting the volume of fluid which can enter the passage of the body in a given period of time at a given suction force imparted by the user. Further, in all modes, the valve means is preferably configured to operate as a one way valve and therefor resist backflow of fluid through the valve and to prevent spillage of fluid from the distal end.

A further and particularly favored mode of the device features a fluid volume restriction chamber, formed in a communication with the axial passage communicating through the straw body. The restriction chamber has a fluid volume defined by its area which is defined by an upper wall, a lower wall, and a sidewall communicating therebetween. The lower wall is preferably provided by the removably engageable valve means when operatively engaged on the distal end of the straw. The upper wall has an aperture centered in the upper wall between the sidewall. Adjacent to the center aperture is a slanted portion forming a seat in the upper wall surface. This seat is adapted to sealably engage with a sealing member operatively positioned within the restriction chamber when the sealing member is biased against the seat by the force of fluid flowing through the restriction chamber.

The sealing member size, or exterior dimension, and/or mass may be varied to adjust the volume and speed of fluid force required for the sealing member to be biased into the seat by moving fluid through the restriction chamber. Ideally, the sealing member is formed of a material having a mass that imparts a density to the sealing member (density equals mass of material×volume) which is greater than the density of the fluid anticipated to flow through a restriction chamber. For example, water has a density of 1.0 and other thin fluids such as juice or soft drinks have a similar low density. The sealing member is preferably formed of a material and in diameter to yield a volumetric area, which when multiplied by the mass of the material forming the member, would preferably be greater than 1.0. Forming the sealing member to have a mass greater than that of the fluid will cause the member to tend to sink as fluid fills or drains from the restriction chamber.

The size of the sealing member as well as the distance of the upper wall from the lower wall will also throttle the rate at which the sealing member is forced toward the seat on the upper wall. A linear flow of fluid past the sealing member will impart a biasing force against it and around it per Bernoulli's Principle, much like an airplane wing, which imparts a lift to the sealing member in the direction of the fluid stream moving through the straw. This lift force will tend to move the sealing member away from the bottom wall and toward the seat.

When calculated properly the variable of distance between the upper and lower walls and density and surface area of the facing surface of the sealing member, the sealing member will be biased by moving fluid and only seat when the fluid flow is accelerated to a calculated velocity to force the sealing member to move distance to the seat. Once seated, fluid flow will cease causing the sealing member to drop away from the seat due to a higher density than the fluid on which it is supported.

In this fashion, the acceleration of the fluid stream exiting the straw can be limited not to exceed a certain maximum speed or acceleration, thereby providing a means for fluid acceleration restriction. This prevents a user who imparts excess suction to the distal end of the straw from having fluid accidentally traverse the throat into the lungs from slow reflexes.

Further, the total potential volume allowed per suction by the user on the straw may be reasonably accurately determined by forming the sealing member of a size and material yielding a density to seat the sealing member against the spaced upper wall and seat, only after a determined period of time, depending on the strength of the user sucking on the straw and the acceleration of the fluid stream. Hard and quick suction by a user will yield faster fluid acceleration and in turn, a faster sealing of the flow since the sealing member will be forced upward quickly to cease flow.

A softer or lower suction action by a user, will yield a slower acceleration of fluid and slower overall fluid flow thereby determining a longer time segment for the sealing member to rise to the seat if the specific gravity of the sealing member and its exterior dimensions are correctly calculated to cause it to rise in the direction of the fluid stream with minimal fluid acceleration. Further adjustments for volume allowed in any one sucking of the straw may be provided by spacing the distance of the upper wall from the lower wall and thus the total volume of the chamber and resulting total distance the sealing member must travel to seat and cease flow.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features which may be configured pursuant to this disclosure. It is intended that the embodiments and figures disclosed herein are to be considered illustrative, rather than limiting.

In the drawings:

FIG. 1 shows an exploded perspective view of a preferred mode of the device comprising a straw body with a restriction chamber, a sealing member, and valve component.

FIG. 1*a* depicts a detailed view of the valve component with the outlet aperture in a closed position.

FIG. 1*b* shows a detailed view of the valve component with the outlet aperture in an open position.

Figure 4:
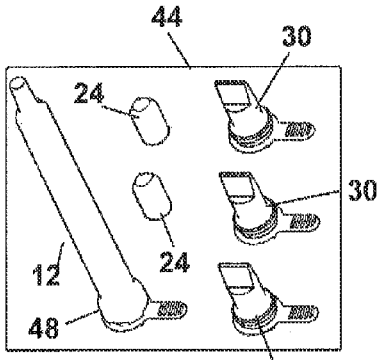
FIG. 4 shows another preferred mode of the device providable as a kit comprising the straw body, a plurality of varying size/mass sealing members, and a plurality of varying flow rate valve component.
Figure 4A:
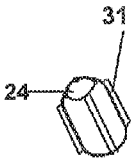

FIG. 4*a* depicts a mode of translating sealing member having projecting fins defining a circumference and having fluid passages therebetween.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
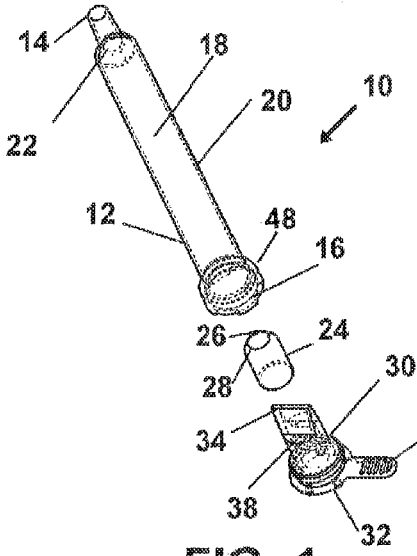

Now referring to drawings in FIGS. 1-4, wherein similar components are identified by like reference numerals, there is seen in FIG. 1 an exploded view of a first preferred mode of the straw device 10 herein. The device 10 is comprised generally of an elongated body 12 having apertures at proximal 14 and distal 16 ends communicating through an axial passage 42 communicating therebetween. The body 12 is preferably formed from conventional materials such as plastic, polymeric material, or metal, however can be formed from any material suitable for the intended purposes set forth in this disclosure.

Figure 3:
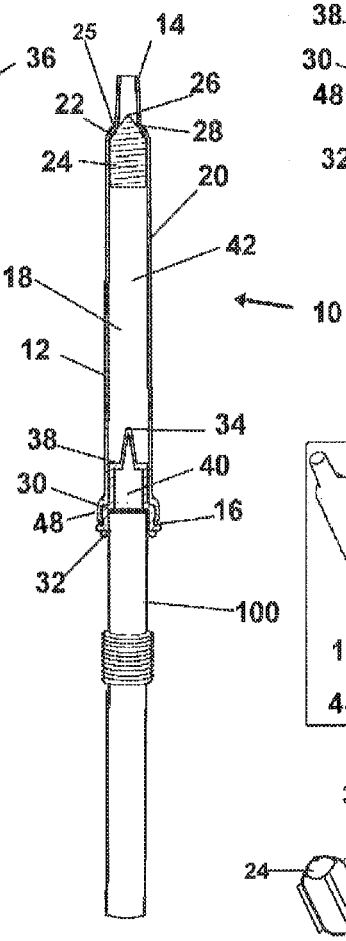
FIG. 3 depicts a side assembled cross sectional view of the device showing the sealing member seated in a sealed position against an upper wall of the restriction chamber.

The device 10 herein disclosed and described provides a means for regulating fluid velocity, maximum volume, and fluid acceleration toward and exiting the proximal end 14 of the device 10. The device 10 is intended to be employed with conventional drinking straws 100, as shown in FIG. 3, in order to allow users with limited facial muscle control or other disabilities to consume liquids through a straw 100 without the chance of choking or aspiration. However, it may be manufactured as a unit with a straw body 100.

In the mode engageable with a drinking straw 100, means for removable engagement to the drinking straw 100 is provided through the insertion of the straw 100 into a distal aperture 32 of the valve component 30 providing a frictional engagement therein. However, it is noted that other configurations and means for engagement to a straw 100 may be employed and are anticipated especially if the device 10 is manufactured as a straw 100 with the operative components noted herein.

Figure 2:
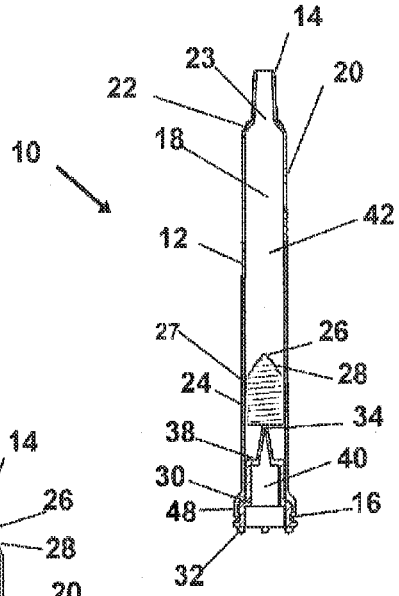
FIG. 2 depicts a side assembled cross sectional view of the device showing the sealing member in a resting position.

The device 10 includes a fluid volume restriction chamber 18, formed in the axial passage 42 communicating through the body 12. The restriction chamber 18 has a volume defined by an endwall or upper wall 22, an opposing second end wall or lower wall 38, and a sidewall 20 communicating there between. The lower wall 38 is preferably provided by a wall surface 38 of the removably engagable valve component 30 when a leading end of the valve component 30 is inserted into the distal end 16 of the body 12, as shown in FIG. 2 and FIG. 3. However, the straw 100 can also provide the lower end and lower wall 38 if there is no second valve component 30.

The first end wall or upper wall 22, as shown, has a center aperture 23 centered in the upper wall 22 between the sidewall 20, and coaxially aligned with the proximal aperture 14 at the proximal end of the body 12. Adjacent to the center aperture 23 is a slanted or angled portion having an area and angle of incline matching that of an end of the sealing member 24 to allow for the forming of a seal with this annular seat portion of the upper wall 22 surface.

As noted, the annular angled section of the upper wall surface 22, is formed at an angle complimentary to that of the leading surface of the translating sealing member 24 positioned for translation inside the restriction chamber 18. During use, when the leading edge 25 of the sealing member 24 is forced against the annular angled complimentary angled surface of the upper wall 22 by the force of fluid flowing through the restriction chamber 18, fluid flow ceases as shown in (FIG. 3).

The sealing member 24 is defined by a circumference configured for a translating engagement within the axial passage 42. The circumferential wall has a diameter sufficiently smaller than the diameter of the interior wall defining the axial passage 42 to thereby define a gap 27 to form a bypass and allow a stream of fluid to flow around the exterior circumference of the sealing member 24. The size of the sealing member 24 defined by the circumference and exterior surfaces thereof, can be varied to yield a mass of the sealing member 24 which may be varied so long as it is sized to form the gap or bypass fluid passage between the wall of the sealing member 24 and the interior wall defining the axial passage, until contact of the sealing member 24 with the upper wall 22. Alternatively, recesses (not shown) may be formed into the exterior surface of the circumference of the sealing member 24 to allow a passage for fluid flow around the sealing member 24 and between the interior wall forming the axial passage, or to increase the bypass fluid flow.

Adjusting the material forming the sealing member 24, and/or its overall size for length and circumference, provides a means to adjust the amount of fluid force from fluid moving through the axial passage 42, required for the sealing member 24 to be forced into the seat (FIG. 3) by moving fluid through the restriction chamber 18.

In the current preferred mode, the sealing member 24 is comprised of a substantially cylindrical body, having a pointed end 26. The circumference of the sealing member 24 is slightly smaller than the circumference of the interior wall surface forming the axial passage 42 to allow a bypass fluid flow therebetween until the sealing member 24 seats.

Further, an angled annular shoulder portion 28 is preferably provided proximal the pointed end 26 on the leading edge of the sealing member 24. The angled annular shoulder portion 28 in addition to sealing against the end wall or upper wall 22, provides a means for releasing the sealing member from the seal with the upper wall 22 when used in conjunction with thickened (nectar consistency) liquids, by essentially reducing the surface area of contact and static adhesion of the shoulder portion 28 with the upper wall 22.

Experimentation has shown that with thickened liquid the sealing member 24 more effectively releases from the seal where there is a reduced contact area between the seal member 24 and the upper wall 22. However, for less viscous fluids, the pointed end of sealing member 24 may have an smooth surface, and the shoulder 28 may not needed.

It is noted that in other modes the sealing member 24 may take on other forms which provide a means for sealing the axial passage 42 at the upper wall 22 while allowing fluid flow before the sealing member 24 seats with the upper wall 22. For example, the sealing member 24 may comprise a spherical body having a surface area defined by a diameter which is sized to provide an operative seal of the central aperture adjacent the upper wall 22 of the restriction chamber 18.

The size defining the mass of the sealing member 24 as well as the distance of the first endwall or upper wall 22 from the second endwall or lower wall 38, affects the timing and rate at which the sealing member 24 is forced toward the seat on the upper wall 22. Again, in use as a user sucks on the proximal end 14, drawing fluid through the valve component 30 and begins to accelerate the fluid through the axial passage 42, the flow of fluid past the exterior circumferential surface of the sealing member 24 will impart a force against it and around it during movement through the gap 27 between the axial passage 42 wall and the circumferential wall of the sealing member 24.

This fluid movement which will impart lift to the sealing member 24 in the direction of the fluid stream moving through the axial passage 42 of the body 12. This lift will tend to move the sealing member 24 away from the bottom wall 38 and toward the seat on the upper wall 22. As the annular shoulder portion 22 contacts the upper wall 22, a fluid seal is provided and fluid flow is stopped.

It is intended that the sealing member 24 will only seat when the fluid flow is accelerated to a sufficient velocity to force it the distance to the upper wall 22. Once seated, fluid flow will cease, causing the sealing member 24 to drop away from the upper wall 22 due to the sealing member 24 having a higher density and no buoyancy in the fluid in which it floats.

In this fashion, the acceleration of the fluid stream exiting the straw can be limited not to exceed a certain velocity wherein the sealing member 24 is fully drawn up into a sealed seat with the upper wall 22, thereby providing a means for fluid acceleration throttling, which prevents a user from sucking too hard and having fluid accidentally traverse the throat into the lungs from slow reflexes.

Again, a hard and quick impart of suction by a user will yield sufficient force and torque for a quick fluid acceleration to a maximum velocity. This causes a faster sealing of the fluid flow since the sealing member 24 will be forced up quickly to cease flow. A softer sucking action will yield a slower fluid acceleration and flow around the sealing member 24, and a longer time for fluid communication around the sealing member 24 as it rises to the seat.

In addition, it is noted that the total potential volume allowed per suck on the straw device 10 may be reasonably accurately determined by forming the sealing member 24 of a size and material yielding a density to seat the sealing member 24 against the spaced upper wall 22, only after a determined period of time, depending on the force of user suction on the straw and acceleration of the fluid stream in the axial passage 42 and around the sealing member 42.

While the sealing member 24 will seat against an inserted straw on a lower end of the axial passage and function well, optionally a means for volumetric flow rate restriction may be provided by the removably engageable secondary valve component 30 as shown. The secondary valve component 30 is configured as a plug to be inserted into a sealed engagement into the distal end 16 and aligned with the axial passage 42 of the body 12. This takes the place of the straw 100 being inserted and provides the lower limit to translation of the sealing member 24.

The secondary valve component 30 comprises a central passage communicating between a distal aperture 32 and proximal aperture 34. The distal aperture 32 is preferably sized to coaxially and frictionally engage a conventional straw 100 as shown, thereby easily adapting the device 10 for employment with conventional straws 100. The secondary valve component 30 is preferably formed of flexible material such as rubber, flexible plastic, or polymeric material, however, can be formed from any material suitable for the intended purpose.

Figure 1A:
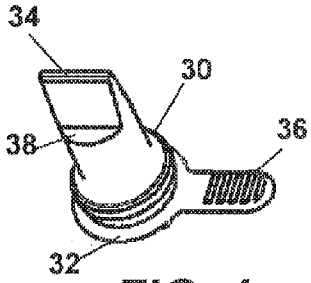
Figure 1B:
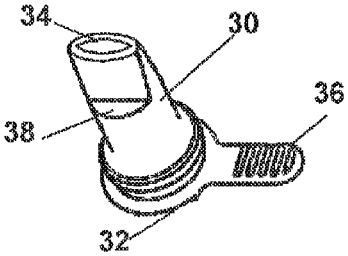

As shown in FIG. 1*a* and FIG. 1*b*, the proximal end aperture 34 is preferably provided by an openable slit or slot which communicates with the central passage 40. Due to the preferably flexible material forming the secondary valve component 30, as a user sucks on the proximal end 14 of the body 12, fluid will be drawn through the distal end 32 of the valve component 30 and into the axial passage 40. As fluid exits the valve component 30, the proximal aperture 34 will start to bow or flex open, by a flexing of the sidewalls 35 forming it and the relative size of the aperture 34 is increased in order to accommodate the increase of fluid accelerating through the device 10, as dictated by the suction force by the user.

As such, the distal aperture 34 will be closed by the opposing sidewalls 35 contracting when the user is not sucking on the device 10, however will open gradually as the walls 35 having an inward bias toward each other, separate when fluid is accelerated through the device 10 by the user sucking from the proximal end 14 to force them open. Therefor, the flow rate of fluid through the valve 30 and therefor the body 12 of the device 10 is regulated or throttled by the gradual opening of this valve component 30 over time, and is limited to a maximum flow rate determined by a maximum area of opening of the distal aperture 34.

Further, in all modes, the valve component preferably only allows one way fluid flow and therefor resists backflow of fluid through the valve to prevent spillage of fluid from the distal end. This is accomplished by forming the valve component 30 to have biased opposing walls 35 which taper towards the proximal end aperture 34 when force to separate them dissipates as shown such that any attempts for fluid to flow backwards will force the aperture 34 closed.

In addition, it is noted that the flow rate of fluid through the valve component 30 can be varied by varying the size of the openable proximal aperture 34, or the biasing force of the opposing sidewalls 35 toward each other, given a certain suction force imparted by the user. Thus, the flexibility of the material forming the valve component 30 will determine how much the sidewalls adjacent the aperture 34 are able to flex in order to bow open.

Finally, in another mode of the device 10 shown in FIG. 4, a kit 44 is providable to the user which includes the straw body 12, and a plurality of valve components 30, each of which can be formed of varying durometer material to vary the flexibility. A pull tab 36 may be provided on the valve component 30 which allows the user, or users caretaker to easily interchange the desired valve component 30 as needed to regulate fluid flow deemed suitable for the user. Also provided can be a plurality of sealing members 24 having differing mass or weight relative to the thickness of the liquid which may be employed. The user would choose the sealing member 24 which has sufficient mass to cause it to sink in the fluid when flow ceases.

Finally shown in FIG. 4*a* is a particularly preferred mode of the translating sealing member 24 having projecting fins 31 extending away from the circumferential surface, and defining a circumference for translation within the axial passage 42. Gaps 33 between the fins 41 define bypass fluid passages for fluid flow until or unless the sealing member 24 seats and ceases flow.

This invention has other applications, potentially, and one skilled in the art could discover these. The explication of the features of this invention does not limit the claims of this application; other applications developed by those skilled in the art will be included in this invention.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A fluid flow regulating apparatus, comprising:

a body having a proximal end in communication with a distal end via an axial passage formed through said body;

a fluid volume restriction chamber formed in said body, said fluid volume restriction chamber having a volume defined by an upper wall having an annular angled surface, a removable lower wall, and a side wall disposed between said upper wall and said lower wall;

a first aperture formed at said proximal end;

a second aperture formed at said distal end, wherein said distal end around said second aperture includes a base wall adjacent to said side wall, wherein the circumference of said base wall is greater than the circumference of said side wall, said base wall being configured to support said apparatus in an upright freestanding position, adapted for creating a sealed engagement to a drinking straw; and a sealing member having a circumferential surface sized for translation inside said fluid volume restriction chamber between said upper wall and said removable lower wall of said fluid volume restriction chamber;

wherein said sealing member is movable between a seated position blocking communication of said first aperture with said axial passage and a second position allowing communication of said first aperture with said axial passage.

2. The fluid flow regulating apparatus of claim 1, wherein said sealing member further comprises a plurality of fins projecting from said circumferential surface of said sealing member.

3. The fluid flow regulating apparatus of claim 1, wherein said proximal end of said body tapers inwardly from said upper wall to said first aperture to allow for said sealed engagement to said drinking straw.

4. The fluid flow regulating apparatus of claim 1, wherein said sealing member further comprises a first end having an annular angled surface formed at an angle complimentary to said annular angled surface of said upper wall.

5. The fluid flow regulating apparatus of claim 1, wherein said sealing member can be removed from and reinserted into said fluid volume restriction chamber via said removable lower wall.

6. The fluid flow regulating apparatus of claim 1, further comprising a secondary valve engaged with said distal end of said body, said secondary valve including a first end disposed within said axial passage, said first end being formed of a flexible material having an inlet aperture formed therein, wherein said inlet aperture has a collapsed state that blocks fluid flow and an open state that provides a passage for said fluid flow.

7. The fluid flow regulating apparatus of claim 6, wherein said secondary valve further comprises a pull tab arranged and configured to allow for removal of said secondary valve from said apparatus.

* * * * *